US010408222B2

(12) United States Patent
Oh

(10) Patent No.: US 10,408,222 B2
(45) Date of Patent: Sep. 10, 2019

(54) COOLING FAN ASSEMBLY

(71) Applicant: Hyundai Motor Company, Seoul (KR)

(72) Inventor: Dong Seok Oh, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 291 days.

(21) Appl. No.: 15/258,912

(22) Filed: Sep. 7, 2016

(65) Prior Publication Data

US 2017/0167505 A1 Jun. 15, 2017

(30) Foreign Application Priority Data

Dec. 11, 2015 (KR) ..... 10-2015-0177000

(51) Int. Cl.

| | |
|---|---|
| ***F04D 29/32*** | (2006.01) |
| ***F04D 25/08*** | (2006.01) |
| ***F04D 29/52*** | (2006.01) |
| ***F04D 29/64*** | (2006.01) |
| ***F04D 19/00*** | (2006.01) |
| ***F04D 29/26*** | (2006.01) |

(52) U.S. Cl.

CPC ..... *F04D 29/329* (2013.01); *F04D 19/002* (2013.01); *F04D 25/08* (2013.01); *F04D 29/263* (2013.01); *F04D 29/522* (2013.01); *F04D 29/644* (2013.01); *F05B 2240/12* (2013.01); *F05B 2240/30* (2013.01); *F05B 2240/941* (2013.01)

(58) Field of Classification Search

None

See application file for complete search history.

(56) References Cited

U.S. PATENT DOCUMENTS

| | | | | |
|---|---|---|---|---|
| 7,855,882 | B2 * | 12/2010 | Franz | F04D 25/082 361/679.48 |
| 2007/0237656 | A1 * | 10/2007 | Pipkorn | F04D 29/526 417/366 |
| 2014/0112809 | A1 * | 4/2014 | Kim | F04D 19/002 417/423.7 |

FOREIGN PATENT DOCUMENTS

| | | | |
|---|---|---|---|
| JP | 3075435 | U | 2/2001 |
| JP | 2006-125301 | A | 5/2006 |
| JP | 2007-218157 | A | 8/2007 |
| JP | 2008-265372 | A | 11/2008 |
| JP | 2008265372 | A * | 11/2008 |
| KR | 10-1353265 | B1 | 1/2014 |

* cited by examiner

*Primary Examiner* — Woody A Lee, Jr.
*Assistant Examiner* — Sabbir Hasan
(74) *Attorney, Agent, or Firm* — Mintz Levin Cohn Ferris Glovsky and Popeo, P.C.; Peter F. Corless

(57) ABSTRACT

A cooling fan assembly that prevents damage by a fire on a motor is provided. The cooling fan assembly includes a fan shroud that is formed to improve the circulation efficiency and is coupled to a vehicle body, a motor that is coupled to the fan shroud and applied with power to generate torque, a power supplying unit that is configured to apply the power to the motor and a blade that is disposed in the torque of the motor is configured to rotate to circulate open air. A blade hub coupled to a rotation shaft of the motor is configured to integrally rotate with the rotation shaft of the motor as a center portion of the blade. When the blade receiving the torque of the motor is static, the blade hub is compromised and the blade is configured to be released from the torque of the motor.

7 Claims, 5 Drawing Sheets

COOLING FAN ASSEMBLY

CROSS-REFERENCE TO RELATED APPLICATION

This application claims priority to and the benefit of Korean Patent Application No. 10-2015-0177000 filed in the Korean Intellectual Property Office on Dec. 11, 2015, the entire contents of which are incorporated herein by reference.

BACKGROUND (a) Field of the Invention

The present invention relates to a cooling fan assembly, and more particularly, to a cooling fan assembly that prevents damage caused by a fire on a motor.

(b) Description of the Related Art

Generally, a cooling fan that rotates a blade to circulate air into a radiator and that cools an engine is installed at a front of an engine compartment of a vehicle. Additionally, when a coolant circulates in the radiator, the cooling fan suctions air to improve a cooling effect and prevents over-heating of an exhaust manifold. Examples of the above-mentioned cooling fan include a cooling fan driven by a pulley installed at a water pump shaft (e.g., a water pump) and a cooling fan installed at a position separated from the engine and driven by an electric motor. In particular, an electric motor type of cooling fan uses a motor for rotating the blade.

The motor is typically coupled to a fan shroud disposed on the radiator to improve cooling efficiency of a fan by supporting a flow of air. However, when the blade remains in a static position and is fixed due to foreign materials deposited or a freezing occurring between the blade and the fan shroud even though power is applied to the motor, subsequent damage caused by a fire on the motor may occur.

The above information disclosed in this section is merely for enhancement of understanding of the background of the invention and therefore it may contain information that does not form the prior art that is already known in this country to a person of ordinary skill in the art.

SUMMARY

The present invention provides a cooling fan assembly that prevents damage caused by a fire on a motor. Additionally, the present invention provides a cooling fan assembly that improves maintenance tasks for a cooling fan including repairs required by damage attributed to a fire, by deposition of foreign materials or a freezing.

An exemplary embodiment of the present invention provides a cooling fan assembly that may include a fan shroud formed to improve circulation efficiency and coupled to a vehicle body, a motor coupled to the fan shroud and applied with power to generate torque, a power supplying unit configured to apply the power to the motor, a blade disposed in the torque of the motor and configured to rotate to circulate air and a blade hub coupled to a rotation shaft of the motor and configured to be integrally rotated with the rotation shaft of the motor as a center portion of the blade.

When the blade receiving the torque of the motor remains in a static position, the function of the blade hub may be compromised and the blade may be released from the torque of the motor. The motor may be coupled to the fan shroud by a fastening member. The fastening member may be coupled to the rotation shaft of the motor when the rotation shaft of the motor is inserted into the blade hub to couple the blade hub may to the rotation shaft of the motor.

The blade hub may include a hub exterior portion forming an edge, a hub center portion formed in an interior side of the hub exterior portion to be spaced apart from the hub exterior portion by a predetermined distance and coupled to the rotation shaft of the motor and a connection portion that connects the hub exterior portion and the hub center portion to each other. The release of the blade from the torque of the motor may be performed by separation of the connecting portion to separate the hub center portion from the hub exterior portion.

A notch may be formed in the connection portion to separate the connection portion. The notch may be formed at a plurality of sides of the connection portion along a rotation direction and may be formed based on the breaking stress of the connection portion. A plurality of connection portions may be formed. The hub exterior portion may be formed to have a circular hollow and the hub center portion may be formed in a concentric circular shape with a hollow of the hub exterior portion.

A notch configured to guide the separation may be formed in the connection portion. The notch may be formed based on breaking stress of the connection portion and may be formed at a plurality of sides of the connection portion along a circumference direction. Further, the notch may be formed at a plurality of sides of the connection portion along a direction with an incline at least equal to an incline of a set angle in relation to a tangent of a point at which the connection portion is formed on an exterior circumference of the hub center portion.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

Figure 1:
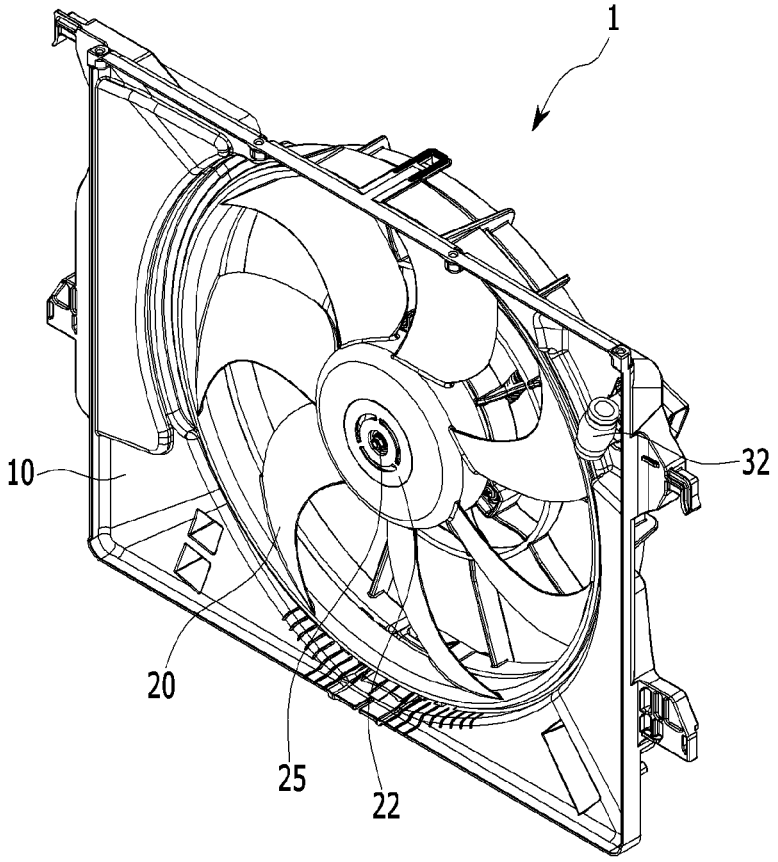
FIG. 1 is an exemplary perspective view of a cooling fan assembly according to an exemplary embodiment of the present invention.

An exemplary embodiment of the present invention will hereinafter be described in detail with reference to the accompanying drawings. The present invention will be described more fully hereinafter with reference to the accompanying drawings, in which exemplary embodiments of the invention are shown. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

A part irrelevant to the description will be omitted to clearly describe the present disclosure, and the same or similar constituent elements will be designated by the same reference numerals throughout the specification. Terms or words used in the specification and the claims should not be interpreted as being limited to a general or dictionary meaning and should be interpreted as a meaning and a concept which conform to the technical spirit of the present disclosure based on a principle that an inventor can appropriately define a concept of a term in order to describe his/her own disclosure by the best method.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

FIG. 1 is an exemplary perspective view of a cooling fan assembly according to an exemplary embodiment of the present invention. As shown in FIG. 1, a cooling fan assembly 1 according to an exemplary embodiment of the present invention may include a fan shroud 10 and a blade 20. The fan shroud 10 may be coupled to a vehicle body. Further, the fan shroud 10 may be mounted on a radiator disposed at a front of an engine compartment to thereby be coupled to the vehicle body. The blade 20 may be surrounded by the fan shroud 10 and may be configured to be rotated. In other words, the fan shroud 10 may provide a cover for the blade 20. Additionally, the blade 20 may be configured to rotate to circulate air into the engine compartment via the radiator by the rotation thereof. Further, the fan shroud 10 may be formed in a shape that supports a flow of air to improve cooling efficiency of the engine based on the circulation by the blade 20. Since basic functions and configurations of the radiator, the fan shroud 10, and the blade 20 described above are apparent to those skilled in the art, a detail description thereof will be omitted.

Figure 2:
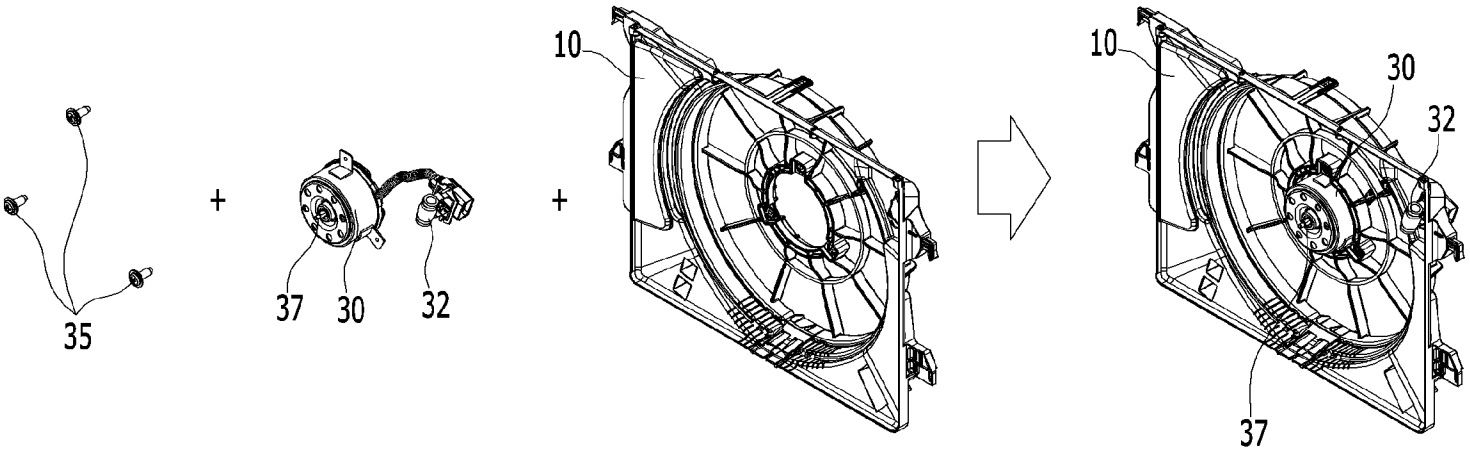
FIGS. 2 and 3 are exemplary assembly views of a cooling fan assembly according to an exemplary embodiment of the present invention.
Figure 3:
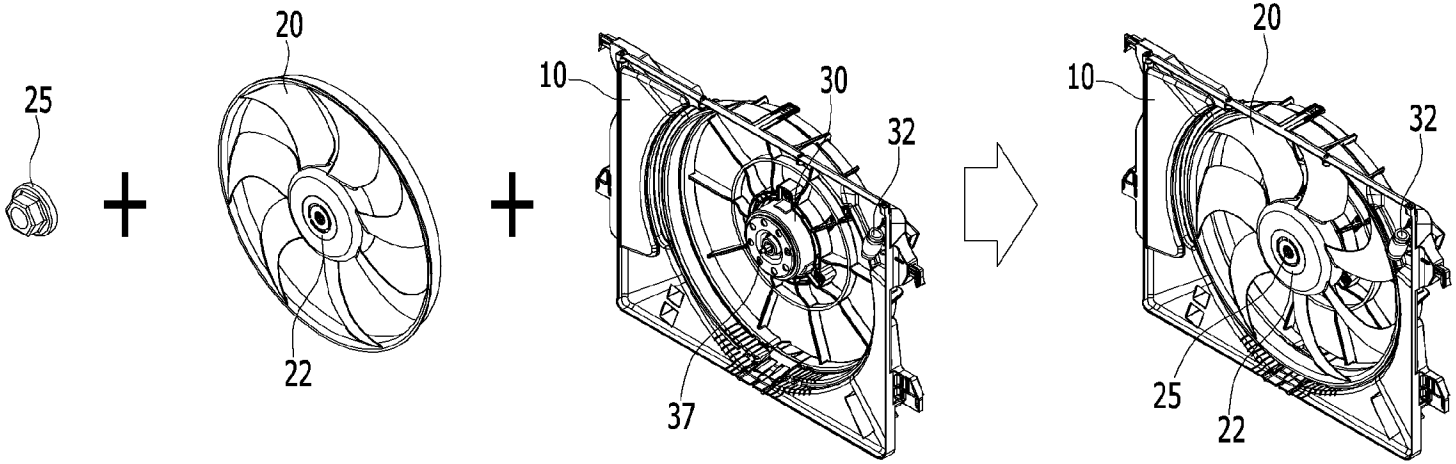

FIGS. 2 and 3 are exemplary assembly views of a cooling fan assembly based on an exemplary embodiment of the present invention. As shown in FIGS. 2 and 3, the cooling fan assembly 1 according to an exemplary embodiment of the present invention may include a motor 30, a power supplying unit 32, a motor fastening member 35, a blade hub 22, and hub fastening member 25.

The motor and supplying unit may be operated by a controller. The motor 30 may be configured to receive power to generate torque based on the power received. Additionally, the motor 30 may be configured to transfer the torque to the blade 20. In other words, the blade 20 may be coupled to a rotation shaft 37 of the motor 30 to be constrained in the torque of the motor 30 and be rotated when the power is applied to the motor 30. The power supplying unit 32 may be configured to supply the power to the motor 30 and the power supplying unit 32 may be mounted on the fan shroud 10.

The motor fastening member 35 may be coupled to the motor 30 and the fan shroud 10 to enable the motor 30 and the fan shroud 10 to be coupled to each other. Additionally, the motor 30 may be mounted on the fan shroud 10 by one or more motor fastening members 35 and the number of motor fastening members 35 may be increased based on a design of those skilled in the art to improve the rigidity of the coupling between the motor 30 and the fan shroud 10. Although FIG. 2 shows three motor fastening members 35, the number of motor fastening members is not limited thereto.

The blade hub 22 may be coupled to the rotation shaft 37 of the motor 30 as a center portion of the blade 20 and may be configured to integrally rotate with the rotation shaft 37. Further, the blade hub 22 may be formed at or provided to the center portion of the blade 20. For example, during a machining process, the blade hub 22 may be integrally molded with the blade 20, or may be injection-molded in the blade 20. When the blade hub 22 is integrally molded with the blade 20, the blade hub 22 and the blade 20 may be formed of the same material. However, when the blade hub 22 is injection-molded in the blade 20, the blade hub 22 and the blade 20 may be formed from different materials. The hub fastening member 25 may be fastened to the rotation shaft 37 of the motor 30. The blade hub 22 and the rotation shaft 37 of the motor 30 may be coupled to each other. Additionally, the hub fastening member 25 may be coupled to the rotation shaft 37 of the motor 30 when the rotation shaft 37 of the motor 30 is inserted into the blade hub 22, to couple the blade hub 22 to the rotation shaft 37 of the motor 30.

As shown in FIG. 2, to assemble the cooling fan assembly 1, the coupling between the motor 30 and the fan shroud 10 may be preconfigured. For example, the power supplying unit 32 coupled to the motor 30 may be mounted on the fan shroud 10 together with the motor 30. As shown in FIG. 3, the assembling of the cooling fan assembly 1 may be completed when the blade 20 is coupled to the rotation shaft 37 of the motor when the motor 30 and the fan shroud 10 are coupled to each other.

Figure 4:
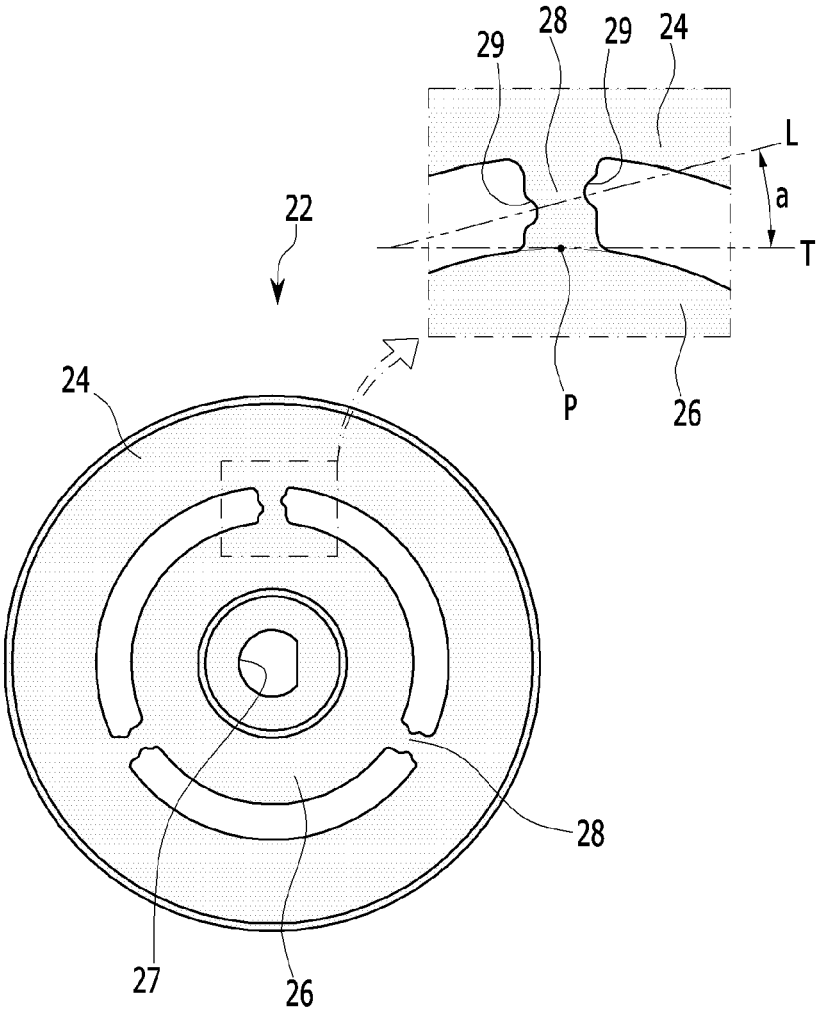
FIG. 4 is an exemplary configuration diagram of a blade hub according to an exemplary embodiment of the present invention.

FIG. 4 is an exemplary configuration diagram of a blade hub according to an exemplary embodiment of the present invention. As shown in FIG. 4, the blade hub 22 may include a hub exterior portion 24, a hub center portion 26, a rotation shaft insertion hole 27, a connection portion 28, and a notch 29. The hub exterior portion 24 may form an edge of the blade hub 22. Additionally, the hub exterior portion 24 may be formed in a ring shape having a circular hollow. The hub center portion 26 may be disposed within the hollow of the hub exterior portion 24 to be spaced apart from the hub exterior portion 24 by a predetermined distance. Further, the hub center portion 26 may be formed in a concentric circular shape with the hollow of the hub exterior portion 24.

The rotation shaft insertion aperture 27 may be an aperture formed in a centrifugal portion of the hub center portion 26. For example, the rotation shaft 37 of the motor may be inserted into the rotation shaft insertion aperture 27. Further, the rotation shaft 37 of the motor may penetrate through the blade hub 22 using the rotation shaft insertion aperture 27 to fasten the hub fastening member 25 to the rotation shaft 37 of the motor 30 when the rotation shaft 37 of the motor 30 is inserted into the blade hub 22.

The connection portion 28 may be formed to connect the hub exterior portion 24 and the hub center portion 26 that are spaced apart from each other. Additionally, at least two or more connection portions 28 may be radially formed. Further, the connection portion 28 may be selectively separated to release the blade 20 constrained in the torque of the motor 30 to be rotated from the torque of the motor 30. For example, the separation of the connection portion 28 may occur when the blade 20 that receives the torque of the motor 30 is static (e.g., not rotated).

When the blade 20 is not rotated even though power is applied to the motor 30 and remains coupled to the fan shroud 10 due to deposition of foreign materials or a freezing that occurs between the blade 20 and the fan shroud 10 the connection portion 28 may be separated to prevent damage by a fire on the motor 30. In other words, the connection portion 28 may be formed to enable the blade 20 coupled to the fan shroud 10 to have a separation stress based on a load determined by the torque of the motor 30.

As described above, the blade hub 22 and the blade 20 using the different materials may be formed to allow the connection portion 28 to have the breaking stress based on a design of those skilled in the art. The notch 29 may include a groove configured to guide the separation of the connection portion 28. Additionally, the notch 29 may provide for the connection portion 28 to be separated based on the separation stress set of the design of those skilled in the art. When a point at which the connection portion 28 is formed on an exterior circumference of the hub center portion 26 is assumed as one point P, the notch 29 may be formed at both sides of the connection portion 28 along a virtual line L that may be inclined at an angle at least equal to a set angle a in relation to a tangent T of the exterior circumference of the hub center portion 26 that passes through the point P.

Figure 5:
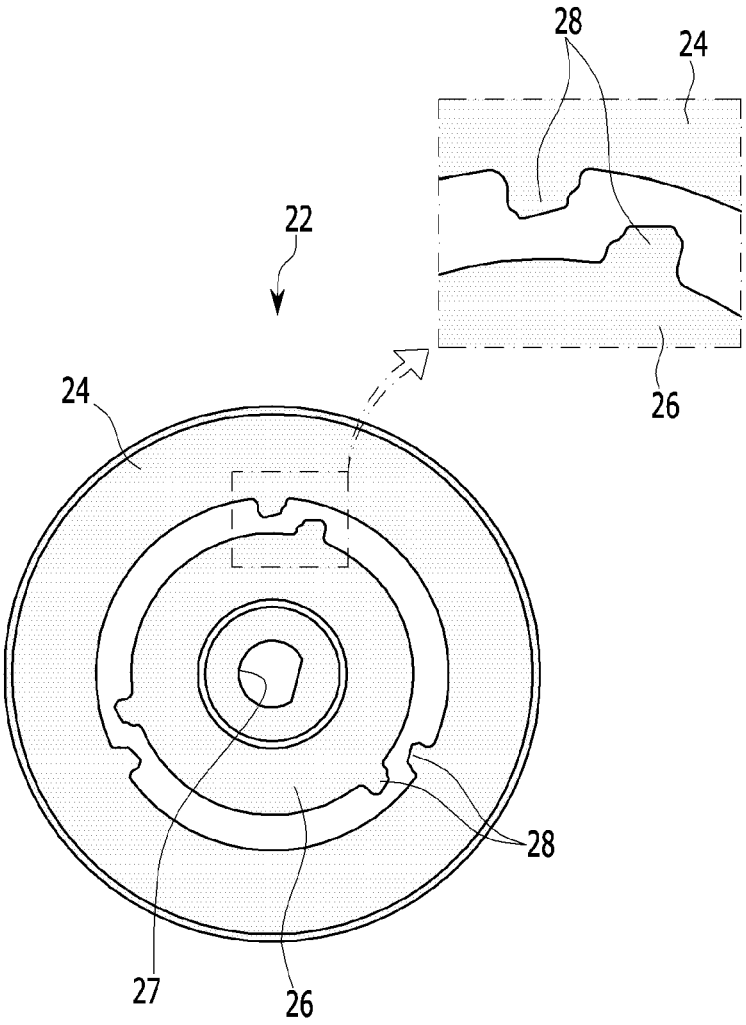
FIG. 5 is an exemplary view illustrating a state in which a portion of the blade hub according to an exemplary embodiment of the present invention is broken.

FIG. 5 is an exemplary view illustrating when a portion of the blade hub according to an exemplary embodiment of the present invention is separated. As shown in FIG. 5, when the blade 20 is coupled to the fan shroud 10, the load applied to the connection portion 28 by the torque of the motor 30 reaches the set breaking stress and the connection portion 28 may be separated in relation to the notch 29. As described above, according to the exemplary embodiments of the present invention, when the blade 20 is coupled to the fan shroud 10 a portion of the blade hub 22 may be separated to prevent the damage by the fire on the motor 30. Additionally, when the portion of the blade hub 22 is separated, the cost of replacement of the blade 20 may be reduced and the ease of assembly and disassembly may be improved rather than when the motor 30 requires replacement, and may improve the ability of a repair.

While this invention has been described in connection with what is presently considered to be exemplary embodiments, it is to be understood that the invention is not limited to the disclosed exemplary embodiments. On the contrary, it is intended to cover various modifications and equivalent arrangements included within the spirit and scope of the appended claims.

What is claimed is:

1. A cooling fan assembly, comprising:

a fan shroud formed to improve circulation efficiency and coupled to a vehicle body;

a power supplying unit configured to generate power;

a motor coupled to the fan shroud and configured to receive the power generated by the power supplying unit to generate torque;

a blade rotating to circulate air by the torque of the motor; and a blade hub coupled to a rotation shaft of the motor and configured to be integrally rotated with the rotation shaft of the motor as a center portion of the blade, wherein when the blade that receives the torque of the motor is static, the blade hub is broken and the blade is released from the torque of the motor, wherein the blade hub includes a hub exterior portion that forms an edge, a hub center portion formed in an interior side of the hub exterior portion to be spaced apart from the hub exterior portion by a predetermined distance, and coupled to the rotation shaft of the motor; and a connection portion that connects the hub exterior portion and the hub center portion to each other, wherein the blade is configured to be released from the torque of the motor when the connection portion has the hub center portion separated from the hub exterior portion, wherein the hub exterior portion is formed in a hollow circular shape, and the hub center portion is formed within the hollow circular shape of the hub exterior portion, wherein a notch configured to guide the separation of the connection portion is formed in the connection portion, and wherein the notch is formed at a plurality of sides of the connection portion along a direction with an incline at least equal to a set angle in relation to a tangent of a point where the connection portion is formed on an exterior circumference of the hub center portion.

2. The cooling fan assembly of claim 1, wherein the motor is coupled to the fan shroud by a fastening member.

3. The cooling fan assembly of claim 2, wherein the fastening member is coupled to the rotation shaft of the motor when the rotation shaft of the motor is inserted into the blade hub to couple the blade hub to the rotation shaft of the motor.

4. The cooling fan assembly of claim 1, wherein the notch is formed at the plurality of sides of the connection portion in a rotation direction.

5. The cooling fan assembly of claim 1, wherein the notch is formed based at a breaking stress point of the connection portion.

6. The cooling fan assembly of claim 1, wherein the blade and the blade hub are integrally molded.

7. The cooling fan assembly of claim 1, wherein the blade hub is formed of a first material that is different from the blade formed of a second material and the blade hub is injection-molded within the blade.

* * * * *